US012703904B2

(12) United States Patent
Park et al.

(10) Patent No.: US 12,703,904 B2
(45) Date of Patent: Aug. 11, 2026

(54) HEALABLE SUPERPLASTIC AMORPHOUS ALLOY

(71) Applicant: SEOUL NATIONAL UNIVERSITY R&DB FOUNDATION, Seoul (KR)

(72) Inventors: Eun Soo Park, Seoul (KR); Geun Hee Yoo, Seoul (KR); Wook Ha Ryu, Seoul (KR); Myeong Jun Lee, Seoul (KR); Min Kyung Kwak, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 666 days.

(21) Appl. No.: 18/018,693

(22) PCT Filed: Jan. 16, 2023

(86) PCT No.: PCT/KR2023/000758
§ 371 (c)(1),
(2) Date: Jan. 30, 2023

(87) PCT Pub. No.: WO2023/191278
PCT Pub. Date: Oct. 5, 2023

(65) Prior Publication Data

US 2024/0093338 A1 Mar. 21, 2024

(30) Foreign Application Priority Data

Mar. 29, 2022 (KR) ..... 10-2022-0039117

(51) Int. Cl.
*C22C 45/10* (2006.01)

(52) U.S. Cl.
CPC ..... *C22C 45/10* (2013.01); *C22C 2200/02* (2013.01)

(58) Field of Classification Search
CPC ... C22C 45/10; C22C 2200/02; C22C 1/0458; C22C 16/00
See application file for complete search history.

(56) References Cited

FOREIGN PATENT DOCUMENTS

CN 108504969 A * 9/2018 ..... C22C 1/11
JP 2005350720 A 12/2005

OTHER PUBLICATIONS

Pauling, Linus. "Atomic radii and interatomic distances in metals." Journal of the American Chemical Society 69.3 (1947): 542-553.*
English Abstract and English Machine Translation of Song (CN 108504969 A) (Sep. 7, 2018).*
Chen, Xiaoyang, et al. "Increasing the cooling rate of Cu mold by liquid alloy coating." Materials Letters 151 (2015): 35-37.*
Scudino, S., J. Eckert, and L. Schultz. "Possible influence of quenched-in nuclei on quasicrystal formation in mechanically alloyed Zr57Ti8Nb2.5Cu13.9Ni11.1Al7.5 glassy powder." Journal of materials research 19.8 (2004): 2211-2215.
Kundig, A. A. et al; "Early crystallization stages in a Zr—Cu—Ni—Al—Ti metallic glass"; Acta Materialia; vol. 53, Issue 7; Apr. 2005; pp. 2091-2099; doi:10.1016/j.actamat.2005.01.022.
Koster; U. et al; "Formation of quasicrystals in bulk glass forming Zr—Cu—Ni—Al alloys"; Materials Science and Engineering; vols. 226-228; Jun. 15, 1997; pp. 995-998; doi:10.1016/S0921-5093(97)80100-1.
Yan, Zhijie; et al.; "Microstructure of Zr—Al—Cu—Ni—Ag Ingot and the Thermal Stability of Corresponding Glass"; Materials Transactions, vol. 44, No. 5; 2003; pp. 907-910; http://dx.doi.org/10.2320/matertrans.44.907.
Xiong; Fan et al; "Microstructural evolution in amorphous-nanocrystalline ZrCu alloy under neutron irradiation"; Acta Materialia; vol. 182; 2020; pp. 18-28.
Sun, Y.J et al.; "Zr—Cu—Ni—Al bulk metallic glasses with superhigh glass-forming ability"; Acta Materialia; vol. 57; 2009; pp. 1290-1299; doi:10.1016/j.actamat.2008.11.007.
Extended European Search Report and Search Opinion received for European Application No. 25161863.3, mailed on Jun. 13, 2025, 9 pages.
Kuhn et al., "ZrNbCuNiAl bulk metallic glass matrix composites containing dendritic bcc phase precipitates", Applied Physics Letters, vol. 80, No. 14, Apr. 8, 2002, 4 pages.
Xing et al., "High-strength materials produced by precipitation of icosahedral quasicrystals in bulk Zr—Ti—Cu—Ni—Al amorphous alloys", Applied Physics Letters, Vo. 74, No. 5, Feb. 1, 1999, 4 pages.
Yan et al., "Microstructure evolution of Zr65Al7.5Cu12.5Ni10Ag5 bulk metallic glass due to rolling and its influence on the thermal stability", Journal of Alloys and Compounds, vol. 513, 2012, pp. 75-79.

* cited by examiner

*Primary Examiner* — Jessee R Roe
(74) *Attorney, Agent, or Firm* — DILWORTH IP, LLC

(57) ABSTRACT

The present disclosure relates to a healable superplastic amorphous alloy, and specifically, to a healable superplastic amorphous alloy capable of exhibiting superplastic behavior and unique healable behavior by maximizing the complexity of the amorphous structure for an Icosahedral quenched-in nuclei quasi-crystal cluster to be formed in the amorphous matrix through the composition limitation and additive element control of Zr—Cu—Ni—Al alloy.

17 Claims, 7 Drawing Sheets

[Figure 1]
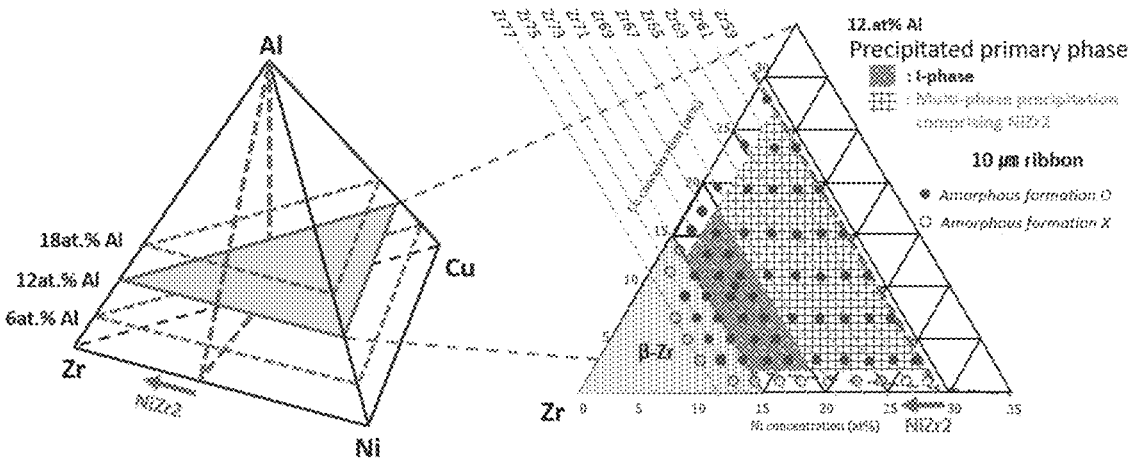
[Figure 2]
I-phase stabilizing element
| Element | Atomic No. | Radius (nm) | Element | Atomic No. | Radius (nm) | Element | Atomic No. | Radius (nm) | Element | Atomic No. | Radius (nm) |
|---|---|---|---|---|---|---|---|---|---|---|---|
| O | 8 | 0.073 | Tc | 43 | 0.136 | Cd | 48 | 0.15683 | Gd | 64 | 0.18013 |
| N | 7 | 0.075 | Mo | 42 | 0.13626 | Hf | 72 | 0.15775 | Y | 39 | 0.18015 |
| C | 6 | 0.0773 | W | 74 | 0.1367 | Mg | 12 | 0.16013 | Sm | 62 | 0.181 |
| B | 5 | 0.082 | Re | 75 | 0.1375 | * Zr | 40 | 0.16025 | Ce | 58 | 0.18247 |
| S | 16 | 0.102 | Pd | 46 | 0.13754 | Pa | 91 | 0.161 | Na | 11 | 0.1857 |
| P | 15 | 0.106 | Pt | 78 | 0.1387 | Sn | 50 | 0.162 | La | 57 | 0.1879 |
| Be | 4 | 0.1128 | Ga | 31 | 0.1392 | Pm | 61 | 0.163 | Ca | 20 | 0.1976 |
| Si | 14 | 0.1153 | Zn | 30 | 0.13945 | Nd | 60 | 0.164 | Eu | 63 | 0.19844 |
| Ge | 32 | 0.124 | Se | 34 | 0.14 | Sc | 21 | 0.1641 | Sr | 38 | 0.2152 |
| Fe | 26 | 0.12412 | U | 92 | 0.142 | Pr | 59 | 0.165 | Ba | 56 | 0.2176 |
| * Ni | 28 | 0.12459 | Nb | 41 | 0.1429 | In | 49 | 0.1659 | K | 19 | 0.231 |
| Cr | 24 | 0.12491 | Ta | 73 | 0.143 | Yb | 70 | 0.17 | Rb | 37 | 0.244 |
| Co | 27 | 0.1251 | * Al | 13 | 0.14317 | Tl | 81 | 0.1716 | Cs | 55 | 0.265 |
| * Cu | 29 | 0.1278 | Au | 79 | 0.1442 | Lu | 71 | 0.17349 | | | |
| V | 23 | 0.1316 | Ag | 47 | 0.14447 | Pb | 82 | 0.17497 | | | |
| Ru | 44 | 0.13384 | Te | 52 | 0.1452 | Er | 68 | 0.17558 | | | |
| Rh | 45 | 0.1345 | Ti | 22 | 0.14615 | Ho | 67 | 0.17661 | | | |
| Mn | 25 | 0.135 | Li | 3 | 0.15194 | Dy | 66 | 0.1774 | | | |
| Os | 76 | 0.13523 | Po | 84 | 0.153 | Tb | 65 | 0.17814 | | | |
| Ir | 77 | 0.13573 | Tm | 69 | 0.156 | Th | 90 | 0.18 | | | |

[Figure 3]
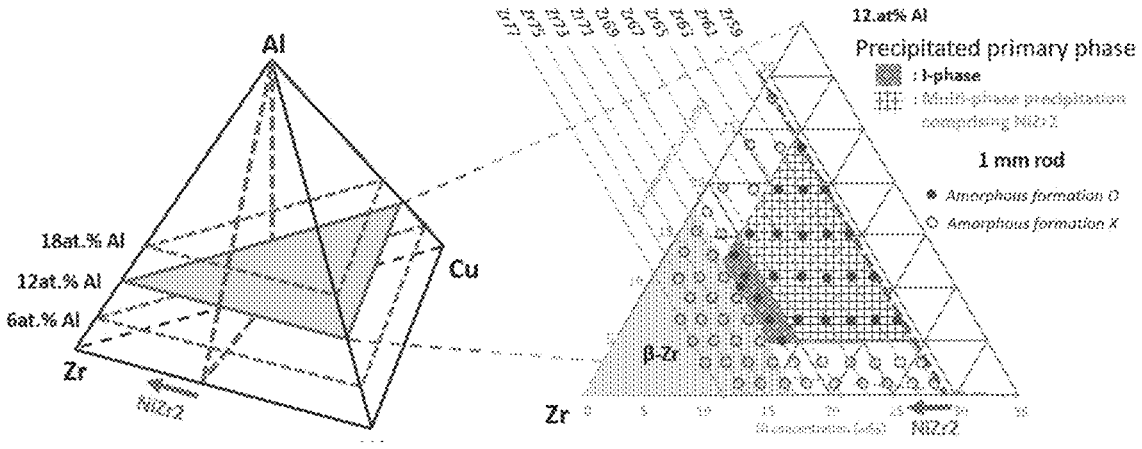
[Figure 4]
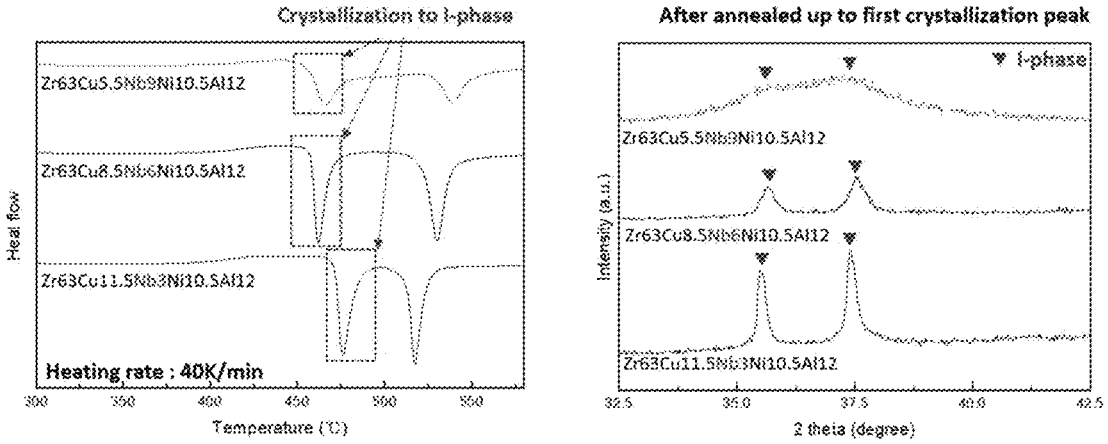

[Figure 5]
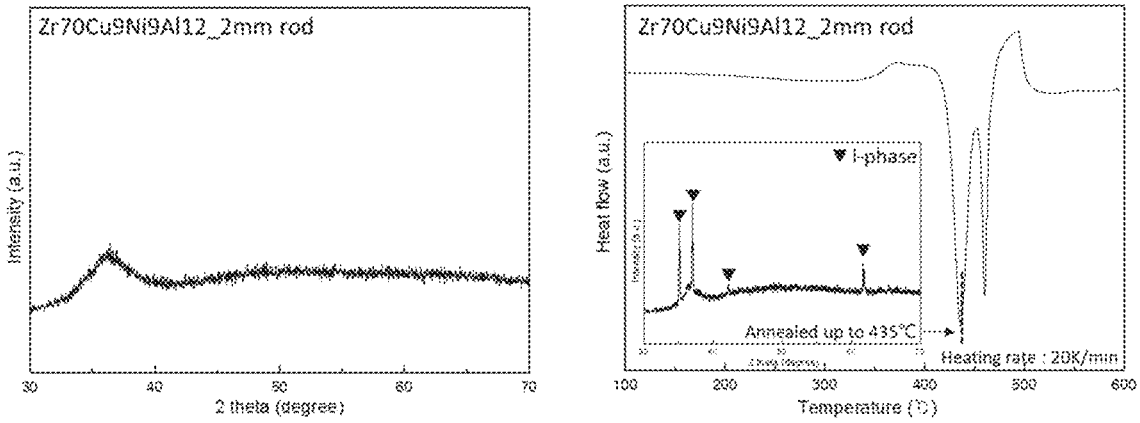
[Figure 6]
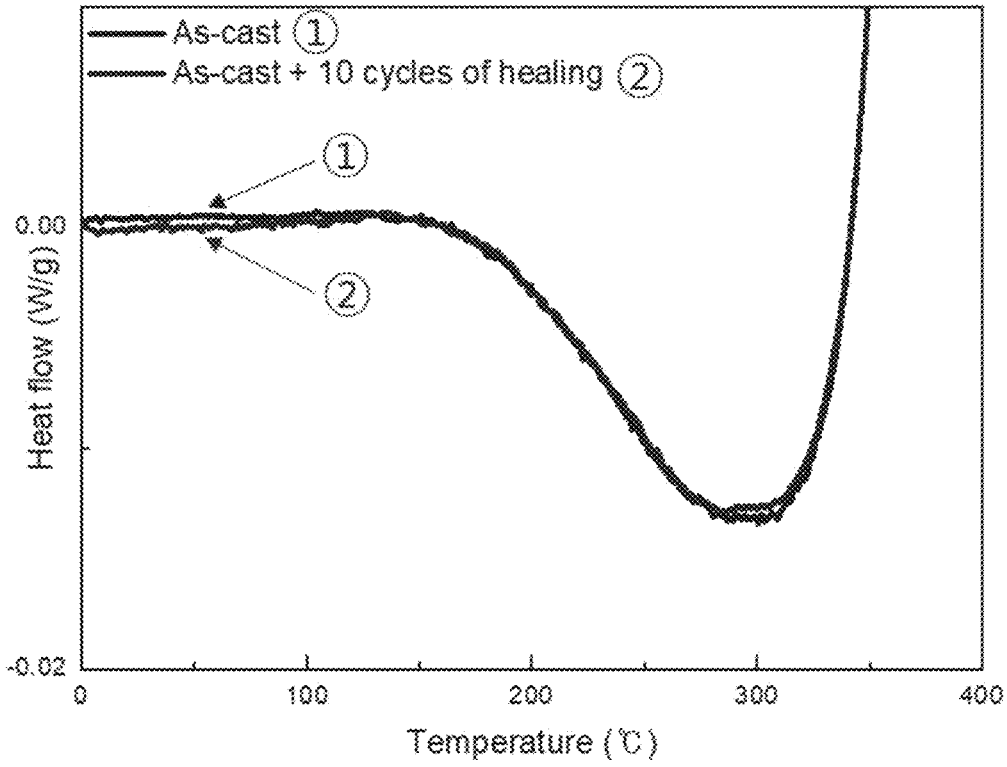

[Figure 7]
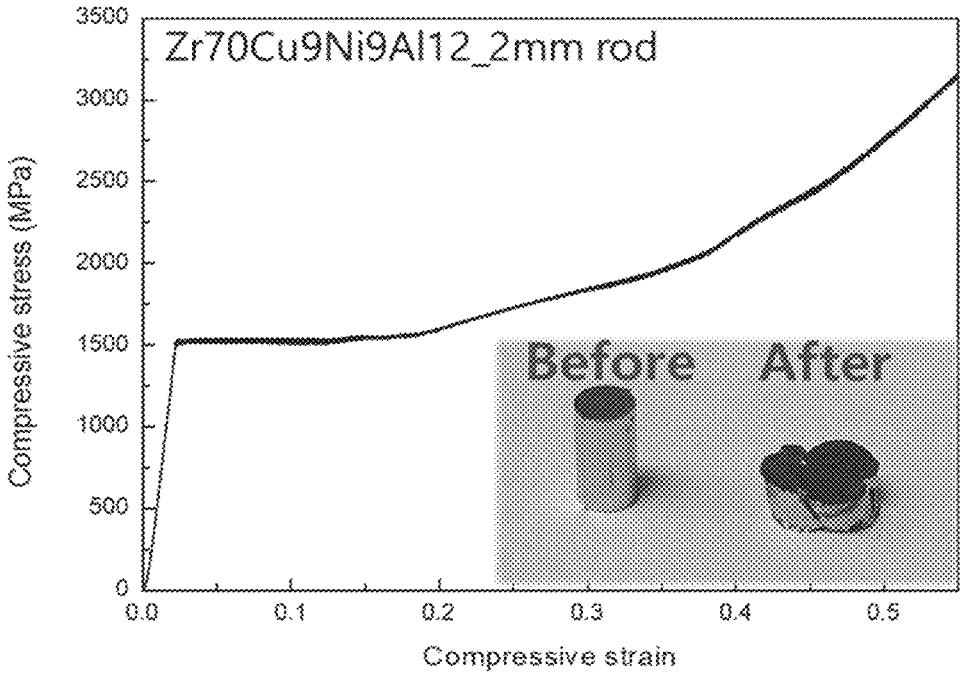

[Figure 8]
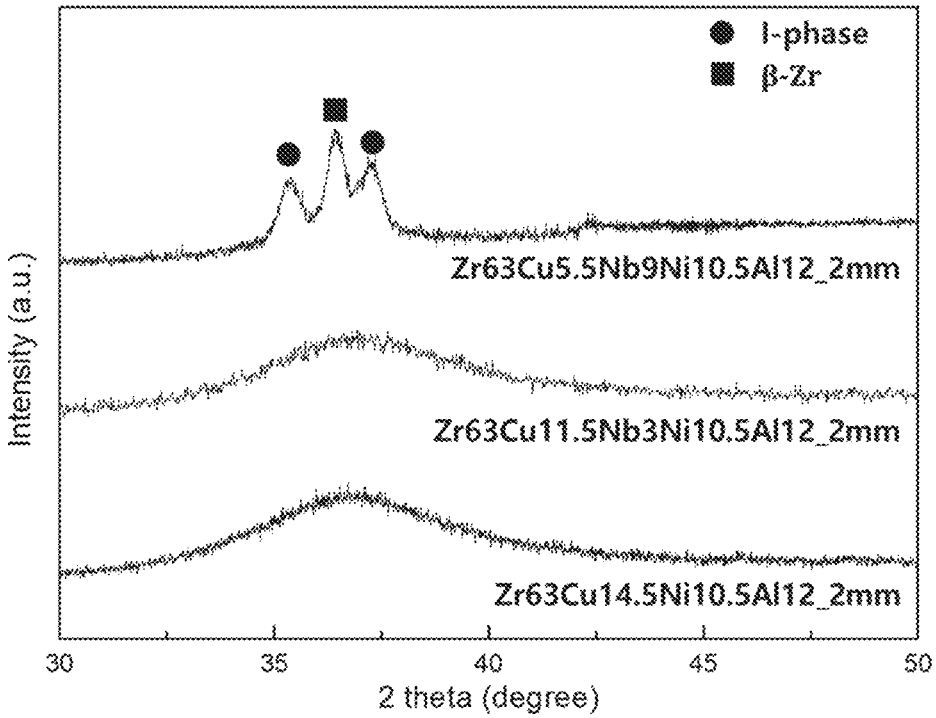
[Figure 9]
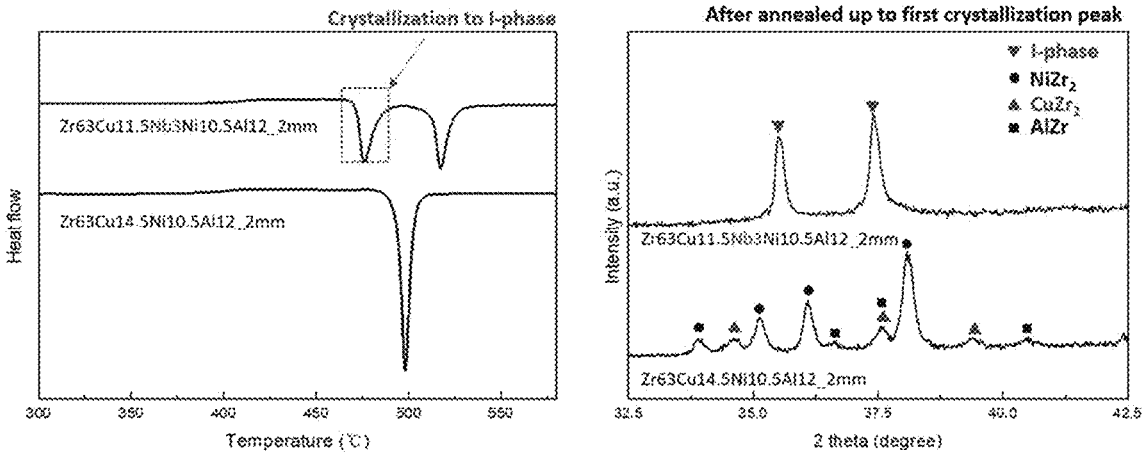

[Figure 10]
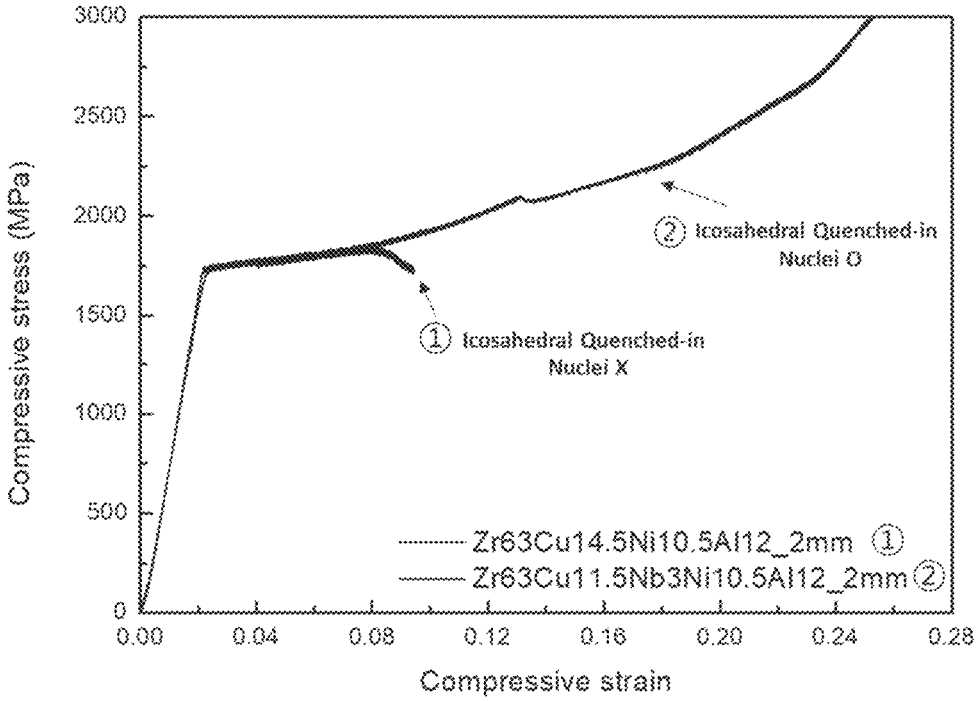

[Figure 11]
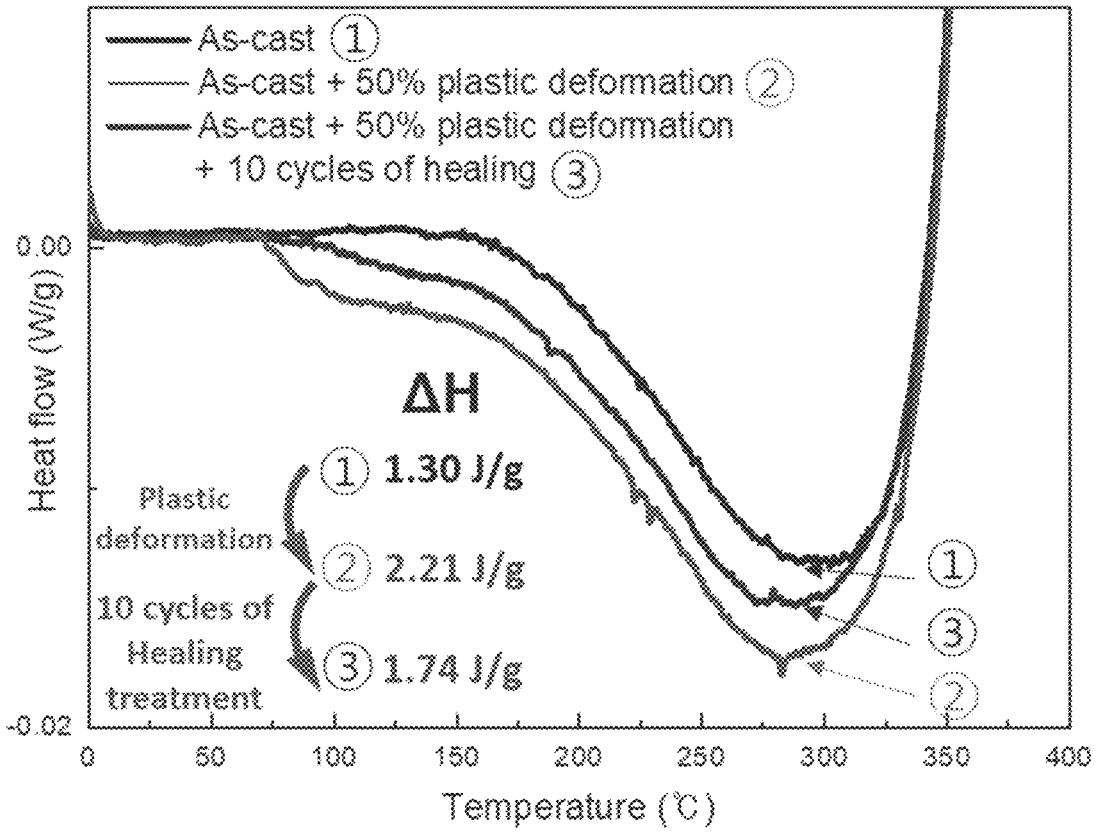

HEALABLE SUPERPLASTIC AMORPHOUS ALLOY

CROSS-REFERENCE TO RELATED APPLICATIONS

The present invention claims the benefit of the filing date of Korean Patent Application No. 10-2022-0039117, filed on Mar. 29, 2022, in the Korean Intellectual Property Office, the entire content of which is included in the present invention.

BACKGROUND OF THE INVENTION

The present disclosure relates to a healable superplastic amorphous alloy, and specifically, to a healable superplastic amorphous alloy capable of exhibiting superplastic behavior and unique healable behavior by maximizing the complexity of the amorphous structure for an Icosahedral quenched-in nuclei quasi-crystal cluster to be formed in the amorphous matrix through the composition limitation and additive element control of Zr—Cu—Ni—Al alloy.

In general, amorphous alloys have high strength and elastic limits (about 2%) compared to crystalline metal materials, and have been widely used for high-quality structural materials thanks to their excellent physical properties.

However, amorphous materials hardly exhibit ductility at or below the amorphous transition temperature, and there are restrictions on commercialization due to limitations in mechanical reliability caused by low fracture toughness. In order to improve the ductility of amorphous alloys, methods of forming shear bands or locally causing structural dilatation by imparting deformation to the material as a post-treatment process have been utilized, but due to the nature of resulting structure, the degree of ductility increase is extremely small while bringing about deterioration of material strength, which causes deterioration in essential characteristics of structural materials, such as fatigue strength and toughness, resulting in the limitation of their use.

Accordingly, the present disclosure is to provide an amorphous alloy which has a superplastic behavior similar to that of crystalline and is imparted with a unique healable property, thereby dramatically improving the mechanical stability and service life thereof.

SUMMARY OF THE INVENTION

The technical object to be achieved by the present disclosure is to provide an amorphous alloy which has a superplastic behavior similar to that of crystalline while being imparted with a unique healable property, thereby dramatically improving the mechanical stability and service life thereof, by maximizing the complexity of the amorphous structure by forming Icosahedral quenched-in nuclei (IQN) within the amorphous matrix in a composition with a high content of Zr through precise composition control and additive element control based on Zr—Cu—Ni—Al quaternary alloy, from the fact that bulk amorphous alloys with medium-range order clusters have relatively excellent elongation properties.

However, the objects to be addressed by the present disclosure are not limited to the above-mentioned problems, and problems other than mentioned above will be clearly appreciated by those skilled in the art from the following description.

DETAILED DESCRIPTION OF THE INVENTION

An embodiment of the present disclosure provides a healable superplastic amorphous alloy including Zr, Cu, Ni, Al and an additive element, wherein the Ni and the Zr form a cluster, the additive element and the cluster form an Icosahedral quenched-in nuclei (IQN) quasi-crystal cluster, and the radius of the additive element is 75% or more and 105% or less with respect to the atomic radius of the Zr.

The healable superplastic amorphous alloy according to an embodiment of the present disclosure can exhibit superplastic behavior similar to that of crystalline even at room temperature, thereby improving mechanical stability.

Additionally, even when being subjected to local deformation up to the plastic deformation region by the formation of a shear band in an extreme use environment, the healable superplastic amorphous alloy according to an embodiment of the present disclosure can restore characteristics through healing by application of external energy.

Effects of the present disclosure are not limited to the above-described effects, but effects other than described above will be clearly appreciated by those skilled in the art from the present specification and accompanying drawings.

BRIEF DESCRIPTION OF DRAWINGS

FIG. 1 is a graph representing a primary precipitated phase during heat treatment and a composition range in which amorphous formation of 10 μm or more is possible with a critical cooling rate of $10^6$ K/s or less with respect to the phase diagram of the Zr-enrich region in which the content of Al is 12 at. % in the Zr—Cu—Ni—Al quaternary alloy group.

FIG. 2 is a diagram in which a total of 73 elements in the periodic table are arranged in order from smallest to largest atomic radius along with their atomic numbers.

FIG. 3 is a graph representing a primary precipitated phase during heat treatment and a composition range in which bulk amorphous formation of 1 mm or more is possible with a critical cooling rate of $10^3$ K/s or less with respect to the phase diagram of the Zr-enrich region in which the content of Al is 12 at. % in the Zr—Cu—Ni—Al quaternary alloy group.

FIG. 4 is a graph representing the X-ray diffraction analysis results after the heat treatment and results of the differential scanning calorimetry of 100 μm plate shapes, which have been prepared when Nb as an additive element (X) was added at 3 at. %, at 6 at. %, and at 9 at. % with respect to the $Zr_{63}Cu_{14.5-c}X_cNi_{10.5}Al_{12}$ composition that is an embodiment of the present disclosure.

FIG. 5 is a graph representing the X-ray diffraction analysis results (a), and the X-ray diffraction analysis result after heat treatment progress up to the first crystallization behavior and the differential scanning calorimetry (DSC analysis) results (b) with respect to $Zr_{70}Cu_9Ni_9Al_{12}$ composition prepared in a 2 mm rod shape that is an embodiment of the present disclosure.

FIG. 6 is a graph representing the results of differential scanning calorimetry of as-cast specimen and a specimen subjected to 10 healing cycles after the casting with respect to $Zr_{70}Cu_9Ni_9Al_{12}$ composition prepared in a 2 mm rod shape that is an embodiment of the present disclosure.

FIG. 7 is a graph representing the compression test results with respect to the $Zr_{70}Cu_9Ni_9Al_{12}$ composition prepared in a 2 mm rod shape that is an embodiment of the present disclosure, and photographs of specimen before and after the compression test.

FIG. 8 is a graph representing the X-ray diffraction analysis results of 2 mm rod-shape specimens, which have been prepared when Nb as an additive element (X) was added at 0 at. %, at 3 at. %, and at 9 at. % with respect to $Zr_{63}Cu_{14.5-c}Nb_cNi_{10.5}Al_{12}$ composition that is an embodiment of the present disclosure.

FIG. 9 is a graph representing the results of differential scanning calorimetry (a) and the results of X-ray diffraction analysis (b) after heat treatment progress up to the first crystallization behavior with respect to 2 mm rod-shaped specimens which have been prepared when Nb was added as an additive element at 0 at. %, and at 3 at. % to $Zr_{63}Cu_{14.5-c}X_cNi_{10.5}Al_{12}$ composition which is an embodiment of the present disclosure.

FIG. 10 is a graph representing the compression experiment results of 2 mm rod-shaped specimens, which have been prepared when Nb as an additive element was added at 0 at. %, and at 3 at. % with respect to $Zr_{63}Cu_{14.5-c}X_cNi_{10.5}Al_{12}$ composition that is an embodiment of the present disclosure.

FIG. 11 is a graph representing the results of differential scanning calorimetry of an as-cast specimen, a specimen after 50% deformation, and a specimen subjected to 10 healing cycles after 50% deformation with respect to $Zr_{63}Cu_{14.5-c}X_cNi_{10.5}Al_{12}$ composition prepared in a 2 mm rod shape which is an embodiment of the present disclosure.

Throughout this specification, when a part "includes" or "comprises" a component, it means not that the part excludes other component, but instead that the part may further include other component unless expressly stated to the contrary.

Throughout the specification, when a member is described as being located "on" another member, this includes not only a case in which the member is in contact with the other member but also a case in which another member exists between the two members.

Throughout the present specification, the term "at. %" may mean the composition ratio of the number of atoms.

Throughout this specification, the phrase "A and/or B" refers to "A and B, or A or B."

Throughout the present specification, the term "bulk" may mean having a thickness of 1 mm or more, or an amorphous forming ability of a critical cooling rate of $10^3$ K/s or less.

Hereinafter, the present disclosure will be described in more detail.

An embodiment of the present disclosure provides a healable superplastic amorphous alloy including Zr, Cu, Ni, Al and an additive element, wherein the Ni and the Zr form a cluster, the additive element and the cluster form an Icosahedral quenched-in nuclei (IQN) quasi-crystal cluster, and the radius of the additive element is 75% or more and 105% or less with respect to the atomic radius of the Zr.

Throughout the present specification, the term "cluster" may refer to what the Ni and the Zr form, and the term "quasi-crystal cluster" may refer to an Icosahedral quenched-in nuclei (IQN) quasi-crystal cluster formed by the additive element and the cluster.

Throughout the present specification, the term "bulk" may mean having a thickness of 1 mm or more and having an amorphous forming ability equal to or greater than the boundary thickness at which brittleness occurs during mechanical deformation.

The healable superplastic amorphous alloy according to an embodiment of the present disclosure can have superplastic behavior similar to that of crystalline even at room temperature, thereby improving mechanical stability.

Even when being subjected to local deformation up to the plastic deformation region by the formation of a shear band, the healable superplastic amorphous alloy according to an embodiment of the present disclosure can restore characteristics through healing by application of external energy due to the role of the Icosahedral quenched-in nucleus as a healing core.

According to an embodiment of the present disclosure, the healable superplastic amorphous alloy includes Zr, Cu, Ni, Al and an additive element. As described above, by the healable superplastic amorphous alloy including Zr, Cu, Ni, Al and an additive element, it is possible as will be described later to implement unique healable property while having a superplastic behavior similar to that of crystalline, by forming a cluster between the Zr and the Ni and by maximizing the complexity of the amorphous structure by causing the cluster to form Icosahedral quenched-in nuclei (IQN) in a composition with a high content of Zr.

According to an embodiment of the present disclosure, Zr may be used as the additive element separately from the Zr included in the healable superplastic amorphous alloy. As described above, by using Zr as the additive element separately from the Zr included in the healable superplastic amorphous alloy, it is possible to exhibit unique healable property while having a superplastic behavior similar to that of crystalline, by maximizing the complexity of the amorphous structure by controlling the stability of the cluster to form an Icosahedral quenched-in nuclei quasi-crystal cluster under the condition of forming a cluster (Principal cluster) formed only of the Ni and the Zr in the matrix.

According to an embodiment of the present disclosure, in the healable superplastic amorphous alloy, the Ni and the Zr form a cluster. Specifically, in the healable superplastic amorphous alloy, the Ni and the Zr are mainly connected to form a principal cluster. As described above, when the Ni and the Zr form a cluster, the complexity of the amorphous structure inside the healable superplastic amorphous alloy can be increased.

According to an embodiment of the present disclosure, in the healable superplastic amorphous alloy, the additive element and the cluster form an Icosahedral quenched-in nuclei (IQN) quasi-crystal cluster. Specifically, in the healable superplastic amorphous alloy, an additive element is disposed between clusters formed of the Ni and the Zr to connect the clusters to each other, and the clusters form Icosahedral quenched-in nuclei (IQN) quasi-crystal clusters by the additive element (Glue atom), so that the healable superplastic amorphous alloy can have a superplastic behavior similar to that of crystalline even at room temperature while exhibiting a unique healable property.

According to an embodiment of the present disclosure, the radius of the added element is 75% or more and 105% or less with respect to the atomic radius of the Zr. Specifically, the radius of the additive element is 76% or more and 104% or less, 77% or more and 103% or less, 78% or more and 102% or less, 79% or more and 101% or less, 80% or more and 102% or less, 81% or more and 101% or less, 82% or more and 100% or less, 85% or more and 97% or less, 88% or more and 95% or less, or 89% or more and 93% or less, with respect to the atomic radius of Zr. Preferably, the radius of the additive element may be 90.2% with respect to the atomic radius of the Zr. Specifically, by implementing that the radius of the additive element is 75% or more and 105% or less with respect to the atomic radius of the Zr, the additive element can effectively adhere between clusters (principal clusters) formed of the Ni and the Zr. As described above, adjusting the radius of the additive element to 75% or more and 105% or less with respect to the atomic radius of the Zr can prevent rapid crystallization due to excessive adhesion of the cluster to one additive element caused by the excessively large radius of the additive element, and can prevent that the clusters are not connected to each other because the radius of the additive element is small.

According to an embodiment of the present disclosure, the additive element may be one selected from the group consisting of Zr, V, Ir, Mo, Re, Pd, Nb, Ta, Au, Ag, Ti, Hf, and combinations thereof. Specifically, Table 1 below is a table showing, as ratios, the differences between the ideal atomic radii of additive elements and the radii of the additive elements. That is, the above elements corresponding to ±10% difference from the ideal atomic radius are listed. When this is converted into a radius size ratio relative to the atomic radius of the Zr, it corresponds to 75% or more and 105% or less with respect to the atomic radius of the Zr. Referring to Table 1 below, since the atoms corresponding to 75% or more and 105% or less with respect to the atomic radius of the Zr, more preferably, 80% or more and 100% or less with respect to the atomic radius of the Zr correspond to Zr, V, Ir, Mo, Re, Pd, Nb, Ta, Au, Ag, Ti, and Hf, the quasi-crystal cluster can be easily formed by selecting the additive element and adhering the clusters to each other. As described above, by using, as the additive element, one selected from the group consisting of Zr, V, Ir, Mo, Re, Pd, Nb, Ta, Au, Ag, Ti, Hf, and combinations thereof, the additive element can easily form an Icosahedral quenched-in nuclei (IQN) quasi-crystal cluster in an amorphous matrix by adhering between the clusters (Principal clusters) formed by the Ni and the Zr.

TABLE 1

| Elemnet | Difference from atomic radius ideal for IQN formation |
|---|---|
| V | −9.0% |
| Ir | −6.1% |
| Mo | −5.8% |
| Re | −4.8% |
| Pd | −3.1% |
| Pt | −3.1% |
| Nb | −1.2% |
| Ta | −1.0% |
| Au | −0.3% |
| Ag | 0.1% |
| Ti | 1.0% |
| Hf | 9.0% |
| Zr | 10.0% |

According to an embodiment of the present disclosure, the content of the Al may be 6 at. % or more and 18 at. % or less. As described above, by adjusting the content of the AI to 6 at. % or more and 18 at. % or less, it can be adjusted so that excellent amorphous forming ability is realized in the superplastic amorphous alloy, and if the content is out of the range, the amorphous forming ability may be rapidly lowered.

FIG. 1 is a graph representing a primary precipitated phase during heat treatment and a composition range in which amorphous formation of 10 μm or more is possible with a critical cooling rate of $10^6$ K/s or less with respect to the phase diagram of the Zr-enrich region in which the content of Al is 12 at. % in the Zr—Cu—Ni—Al quaternary alloy group. Referring to said FIG. 1, the range in which amorphous is formed when the thickness is 10 μm or more and 20 mm or less in the cooling process of the molten metal of the healable superplastic amorphous alloy will be described in detail. The term "thickness of molten metal", as used in this specification, may refer to the smallest thickness of a three-dimensional shape formed of the molten metal. Specifically, in the three-dimensional shape formed of the molten metal, it may refer to the shortest one of distances between a straight line passing through the inside of the three-dimensional shape and the outer surface thereof.

According to an embodiment of the present disclosure, the critical cooling rate of the cooling process of the molten metal of the healable superplastic amorphous alloy may be $10^0$ K/s or more and $10^6$ K/s or less. As described above, by adjusting the critical cooling rate of the cooling process of the molten metal of the healable superplastic amorphous alloy to $10^0$ K/s or more and $10^6$ K/s or less, the alloy of the aforementioned specific composition can be implemented in an amorphous structure.

According to an embodiment of the present disclosure, in the cooling process of the molten metal of the healable superplastic amorphous alloy, the thickness of the molten metal may be 10 μm or more and 20 mm or less. Specifically, in the cooling process of the molten metal of the healable superplastic amorphous alloy, by implementing the thickness of the molten metal of 10 μm or more and 20 mm or less, the critical cooling rate of the cooling process of the molten metal of the healable superplastic amorphous alloy may be adjusted to be $10^0$ K/s or more and $10^6$ K/s or less. As described above, by adjusting the thickness of the molten metal to be 10 μm or more and 20 mm or less in the cooling process of the molten metal of the healable superplastic amorphous alloy, an appropriate critical cooling rate is realized, so that the alloy of the specific composition can be implemented in an amorphous structure.

According to an embodiment of the present disclosure, the critical cooling rate of the cooling process of the molten metal of the healable superplastic amorphous alloy may be $10^0$ K/s or more and $10^6$ K/s or less, wherein when the additive element is Zr, the content of Zr may be greater than 68 at. % and less than or equal to 73 at. %, the content of Ni may be 2 at. % or more and 24 at. % or less, the content of Cu may be 2 at. % or more and 24 at. % or less, and the content of Al may be 6 at. % or more and 18 at. % or less. Alternatively, in the cooling process of the molten metal of the healable superplastic amorphous alloy, the thickness of the molten metal may be 10 μm or more and 20 mm or less, wherein when the additive element is Zr, the content of the Zr may be greater than 68 at. % and less than or equal to 73 at. %, the content of the Ni may be 2 at. % or more and 24 at. % or less, the content of the Cu may be 2 at. % or more and 24 at. % or less, and the content of the Al may be 6 at. % or more and 18 at. % or less.

According to an embodiment of the present disclosure, the critical cooling rate of the cooling process of the molten metal of the healable superplastic amorphous alloy may be $10^0$ K/s or more and $10^6$ K/s or less, wherein when the additive element is an element other than Zr, the content of Zr may be 59 at. % or more and 68 at. % or less, the content of Ni may be 2 at. % or more and 29 at. % or less, and the content of Cu may be 2 at. % or more and 29 at. % or less, and the content of Al may be 6 at. % or more and 18 at. % or less. Alternatively, in the cooling process of the healable superplastic amorphous alloy, the thickness of the molten metal may be 10 μm or more and 20 mm or less, wherein when the additive element is an element other than Zr, the content of the Zr may be 59 at. % or more and 68 at. % or less, the content of the Ni may be 2 at. % or more and 29 at. % or less, the content of the Cu may be 2 at. % or more and 29 at. % or less, and the content of the Al may be 6 at. % or more and 18 at. % or less.

According to an embodiment of the present disclosure, the healable superplastic amorphous alloy may be represented by Formula 1.

$$Zr_aCu_{b-c}X_cNi_dAl_f \quad \text{[Formula 1]}$$

where X is one selected from the group consisting of V, Mo, Nb, Ta, Ag, Ti, Hf, and combinations thereof, b−c is 2 or more and 29 or less, c is 1 or more and 10 or less, d is 2 or more and 29 or less, f is 6 or more and 18 or less, and a is 100−(b+d+f).

As described above, by selecting the amorphous alloy corresponding to Formula 1, an amorphous structure having Icosahedral quenched-in nuclei quasi-crystal clusters can be formed in the alloy, and the mechanical strength of the alloy at room temperature can be maintained while, at the same time, the ductility can be improved.

According to an embodiment of the present disclosure, Equation 1 below may be satisfied for X in Formula 1 above.

$$\tfrac{1}{3}(\text{at. \% of Ti})+\tfrac{1}{3}(\text{at. \% of Nb})+\tfrac{1}{3}(\text{at. \% of Ta})+\tfrac{1}{3}(\text{at. \% of Mo})+\tfrac{1}{7}(\text{at. \% of V})+\tfrac{1}{7}(\text{at. \% of Hf})+\tfrac{1}{6}(\text{at. \% of Ag})\geq 1.0 \quad \text{[Equation 1]}$$

As described above, when the amorphous alloy components satisfy Equation 1 above for X in Formula 1 above, an amorphous structure having Icosahedral quenched-in nuclei quasi-crystal clusters can be formed in the alloy, and the mechanical strength of the alloy at room temperature can be maintained while, at the same time, the ductility can be improved.

According to an embodiment of the present disclosure, the healable superplastic amorphous alloy may be a bulk amorphous alloy having the critical cooling rate of $10^0$ K/s or more and $10^3$ K/s or less in the cooling process of the molten metal thereof. As described above, by adjusting the critical cooling rate of the cooling process of the molten metal of the healable superplastic amorphous alloy to $10^0$ K/s or more and $10^3$ K/s or less, the alloy of the aforementioned specific composition can be implemented as an amorphous structure in bulk form.

According to an embodiment of the present disclosure, in the cooling process of the molten metal of the healable superplastic bulk amorphous alloy, the thickness of the molten metal may be 1 mm or more and 20 mm or less. Specifically, in the cooling process of the molten metal of the superplastic bulk amorphous alloy, by implementing the thickness of the molten metal of 1 mm or more and 20 mm or less, the critical cooling rate of the cooling process of the molten metal of the healable superplastic bulk amorphous alloy may be adjusted to be $10^0$ K/s or more and $10^3$ K/s or less. As described above, in the cooling process of the molten metal of the superplastic bulk amorphous alloy, by adjusting the thickness of the molten metal to be 1 mm or more and 20 mm or less, an appropriate critical cooling rate is realized, so that the alloy of the specific composition can be implemented in an amorphous structure in bulk form.

According to an embodiment of the present disclosure, the critical cooling rate in the cooling process of the molten metal of the healable superplastic bulk amorphous alloy may be $10^0$ K/s or more and $10^3$ K/s or less, wherein when the additive element is Zr, the content of Zr may be greater than 68 at. % and less than or equal to 70 at. %, the content of Ni may be 5 at. % or more and 21 at. % or less, the content of Cu may be 5 at. % or more and 21 at. % or less, and the content of Al may be 6 at. % or more and 18 at. % or less. Alternatively, in the cooling process of the molten metal of the healable superplastic bulk amorphous alloy, the thickness of the molten metal may be 1 mm or more and 20 mm or less, wherein when the additive element is Zr, the content of Zr may be greater than 68 at. % and less than or equal to 70 at. %, the content of Ni may be 5 at. % or more and 21 at. % or less, the content of Cu may be 5 at. % or more and 21 at. % or less, and the content of Al may be 6 at. % or more and 18 at. % or less.

According to an embodiment of the present disclosure, the critical cooling rate in the cooling process of the molten metal of the healable superplastic bulk amorphous alloy may be $10^0$ K/s or more and $10^3$ K/s or less, wherein when the additive element is an element other than Zr, the content of Zr may be 59 at. % or more and 68 at. % or less, the content of Ni may be 5 at. % or more and 26 at. % or less, and the content of Cu may be 5 at. % or more and 26 at. % or less, and the content of Al may be 6 at. % or more and 18 at. % or less. Alternatively, in the cooling process of the molten metal of the healable superplastic bulk amorphous alloy, the thickness of the molten metal may be 1 mm or more and 20 mm or less, wherein when the additive element is an element other than Zr, the content of Zr may be 59 at. % or more and 68 at. % or less, the content of Ni may be 5 at. % or more and 26 at. % or less, the content of Cu may be 5 at. % or more and 26 at. % or less, and the content of Al may be 6 at. % or more and 18 at. % or less.

According to an embodiment of the present disclosure, the healable superplastic bulk amorphous alloy may be represented by Formula 2.

$$Zr_aCu_{b-c}X'_cNi_dAl_f \quad \text{[Formula 2]}$$

where X' is one selected from the group consisting of V, Mo, Nb, Ta, Ag, Ti, Hf, and combinations thereof, b−c is 5 or more and 26 or less, c is 1 or more and 8 or less, d is 5 or more and 26 or less, f is 6 or more and 18 or less, and a is 100−(b+d+f).

As described above, by selecting the healable superplastic bulk amorphous alloy corresponding to Formula 2, an amorphous structure having Icosahedral quenched-in nuclei quasi-crystal clusters can be formed in the alloy, and the mechanical strength of the alloy at room temperature can be maintained while, at the same time, the ductility can be improved.

According to an embodiment of the present disclosure, Equation 2 below may be satisfied for X' in Formula 2 above.

$$\tfrac{1}{3}(\text{at. \% of Ti})+\tfrac{1}{3}(\text{at. \% of Nb})+\tfrac{1}{3}(\text{at. \% of Ta})+\tfrac{1}{3}(\text{at. \% of Mo})+\tfrac{1}{7}(\text{at. \% of V})+\tfrac{1}{7}(\text{at. \% of Hf})+\tfrac{1}{6}(\text{at. \% of Ag})\geq 1.0 \quad \text{[Equation 2]}$$

As described above, when the healable superplastic bulk amorphous alloy components satisfy Equation 2 above for X' in Formula 2 above, an amorphous structure having Icosahedral quenched-in nuclei quasi-crystal clusters can be formed in the alloy, and the mechanical strength of the alloy at room temperature can be maintained while, at the same time, the ductility can be improved.

According to an embodiment of the present disclosure, the cluster may be $NiZr_2$. Specifically, the atoms forming the cluster may be the Zr and the Ni, and the atomic ratio of the Zr and the Ni may be 2:1. As described above, by implementing the cluster whose chemical formula is $NiZr_2$, the coupling shape of the cluster can be adjusted, and the shape and size of the cluster can be adjusted by the additive element, so that clusters can be easily connected with each other to form the Icosahedral quasi-crystal cluster.

According to an embodiment of the present disclosure, in the cluster, the Ni and the Zr form a polyhedron, and the Ni may be disposed at the center of the polyhedron. Specifically, the polyhedron may be an icosahedron. More specifically, the one Ni atom may be provided at the center, and the remaining atoms may be located at vertices of the icosahedron to form a cluster. By forming the cluster as described above, the cluster easily forms an Icosahedral quenched-in nuclei quasi-crystal cluster by the additive element to maximize the complexity of the amorphous structure of the healable superplastic amorphous alloy, so that it can exhibit unique healable property while having a superplastic behavior similar to that of crystalline.

According to an embodiment of the present disclosure, the radius of the additive element may be 0.120 nm or more and 0.169 nm or less. FIG. 2 is a diagram in which a total of 73 elements in the periodic table are arranged in order from smallest to largest atomic radius along with their atomic numbers. As can be seen from the drawing, the radius of the additive element added to the Zr—Cu—Ni—Al quaternary alloy to induce lattice distortion of the cluster and promote adhering so that the Icosahedral quenched-in nuclei (IQN) quasi-crystal cluster is precipitated in a primary precipitated phase during crystallization may be 0.1316 nm or more and 0.15775 nm or less. Preferably, the radius of the additive element may be 0.1445 nm. As described above, by adjusting the radius of the additive element, the additive element can cause adhesion between the principal clusters formed by the Ni and the Zr, and the cluster is prevented from exhibiting crystalline due to its excessive adhesion caused by the excessively large radius of the additive element, and it is possible to prevent the disconnection of the cluster due to the small radius of the additive element.

According to an embodiment of the present disclosure, the plastic deformation region of the healable superplastic amorphous alloy may be recovered by application of external energy including one selected from the group consisting of mechanical energy, electrical energy, thermal energy, magnetic energy, and combinations thereof.

According to an embodiment of the present disclosure, when the external energy is thermal energy, the thermal energy application may be a thermo-cycling process in which an environment of −50° C. or less and an environment of 100° C. or more are alternately performed at intervals of a time period of 20 seconds or more.

An embodiment of the present disclosure provides a method for preparing a healable superplastic amorphous alloy, the method including: forming a composition by mixing Zr, Cu, Ni, Al and an additive element; preparing an alloy by melting and then solidifying the composition.

The method for preparing a superplastic amorphous alloy according to an embodiment of the present disclosure maximizes the complexity of the amorphous structure, and can be implemented to exhibit unique healable characteristics while having a superplastic behavior similar to that of crystalline.

Hereinafter, the present disclosure will be described in detail with reference to examples. However, it should be noted that the examples according to the present disclosure may be modified into various other forms, and the scope of the present disclosure is not construed as being limited to the examples to be described below. The examples of the present specification are provided to more completely explain the present disclosure to those of ordinary skill in the art.

EXPERIMENTAL EXAMPLE 1

In the Zr—Cu—Ni—Al quaternary alloy group, after fixing the content of the Al to 12 at. %, while adjusting the content of the Ni and the content of the Cu as shown in Table 2 below, and adjusting the content of the Zr to have a remainder, a ribbon of 10 μm and a rod shape of 1 mm were prepared, and the content of the additive element was included in the content of the Zr. Thereafter, while adjusting the content of the Ni and the content of the Cu, the internal crystals of the bulk amorphous alloy were checked to determine whether there were superplastic behavior and quasi-crystal formation in the primary precipitated phase, and the results were summarized in Table 2 below. In the table below, the formation of quasi-crystal cluster is indicated by I-phase.

FIG. 3 is a graph representing a primary precipitated phase during heat treatment and a composition range in which bulk amorphous formation of 1 mm or more is possible with a critical cooling rate of $10^3$ K/s or less with respect to the phase diagram of the Zr-enrich region in which the content of Al is 12 at. % in the Zr—Cu—Ni—Al quaternary alloy group.

Referring to FIG. 3, it was confirmed that as the content of the Ni and the content of the Cu decreased from about 29 at. %, the cluster as $NiZr_2$ was formed, but the quasi-crystal cluster was not formed. Then, it was confirmed that when the content of the Ni and the content of the Cu continued to decrease, the quasi-crystal was formed at a specific point, while, when the sum of the content of the Ni and the content of the Cu was continuously decreased to less than about 18 at. %, the bulk amorphous was not formed because crystalline phase was formed.

TABLE 2

| Composition | 10 μm ribbon amorphous formation or not | 1 mm rod shape amorphous formation or not | Primary precipitated phase | Superplastic behavior and healable or not |
|---|---|---|---|---|
| Zr59Cu1Ni28Al12 | X | X | — | — |
| Zr59Cu3Ni26Al12 | ○ | X | $NiZr_2$, AlZr, $CuZr_2$ | X |
| Zr59Cu7Ni21Al12 | ○ | ○ | $NiZr_2$, AlZr, $CuZr_2$ | X |
| Zr59Cu11Ni18Al12 | ○ | ○ | $NiZr_2$, AlZr, $CuZr_2$ | X |
| Zr59Cu15Ni14Al12 | ○ | ○ | $NiZr_2$, AlZr, $CuZr_2$ | X |
| Zr59Cu19Ni10Al12 | ○ | ○ | $NiZr_2$, AlZr, $CuZr_2$ | X |
| Zr59Cu23Ni6Al12 | ○ | ○ | $NiZr_2$, AlZr, $CuZr_2$ | X |
| Zr59Cu28Ni1Al12 | ○ | X | $CuZr_2$ | X |
| Zr61Cu1Ni26Al12 | X | X | — | — |
| Zr61Cu3Ni24Al12 | ○ | X | $NiZr_2$, AlZr, $CuZr_2$ | X |
| Zr61Cu7Ni20Al12 | ○ | ○ | $NiZr_2$, AlZr, $CuZr_2$ | X |
| Zr61Cu11Ni16Al12 | ○ | ○ | $NiZr_2$, AlZr, $CuZr_2$ | X |
| Zr61Cu15Ni12Al12 | ○ | ○ | $NiZr_2$, AlZr, $CuZr_2$ | X |
| Zr61Cu19Ni8Al12 | ○ | ○ | $NiZr_2$, AlZr, $CuZr_2$ | X |

TABLE 2-continued

| Composition | 10 μm ribbon amorphous formation or not | 1 mm rod shape amorphous formation or not | Primary precipitated phase | Superplastic behavior and healable or not |
|---|---|---|---|---|
| Zr61Cu23Ni4Al12 | ○ | X | $NiZr_2$, AlZr, $CuZr_2$ | X |
| Zr63Cu1Ni24Al12 | X | X | — | — |
| Zr63Cu3Ni22Al12 | ○ | X | $NiZr_2$, AlZr, $CuZr_2$ | X |
| Zr63Cu7Ni18Al12 | ○ | ○ | $NiZr_2$, AlZr, $CuZr_2$ | X |
| Zr63Cu11Ni14Al12 | ○ | ○ | $NiZr_2$, AlZr, $CuZr_2$ | X |
| Zr63Cu15Ni10Al12 | ○ | ○ | $NiZr_2$, AlZr, $CuZr_2$ | X |
| Zr63Cu19Ni6Al12 | ○ | ○ | $NiZr_2$, AlZr, $CuZr_2$ | X |
| Zr63Cu24Ni1Al12 | ○ | X | $CuZr_2$ | X |
| Zr65Cu1Ni22Al12 | X | X | — | — |
| Zr65Cu3Ni20Al12 | ○ | X | $NiZr_2$, AlZr, $CuZr_2$ | X |
| Zr65Cu7Ni16Al12 | ○ | ○ | $NiZr_2$, AlZr, $CuZr_2$ | X |
| Zr65Cu11Ni12Al12 | ○ | ○ | $NiZr_2$, AlZr, $CuZr_2$ | X |
| Zr65Cu15Ni8Al12 | ○ | ○ | $NiZr_2$, AlZr, $CuZr_2$ | X |
| Zr65Cu19Ni4Al12 | ○ | X | $NiZr_2$, AlZr, $CuZr_2$ | X |
| Zr67Cu1Ni20Al12 | X | X | — | — |
| Zr67Cu3Ni18Al12 | ○ | X | $NiZr_2$, AlZr, $CuZr_2$ | X |
| Zr67Cu7Ni14Al12 | ○ | ○ | $NiZr_2$, AlZr, $CuZr_2$ | X |
| Zr67Cu11Ni10Al12 | ○ | ○ | $NiZr_2$, AlZr, $CuZr_2$ | X |
| Zr67Cu15Ni6Al12 | ○ | ○ | $NiZr_2$, AlZr, $CuZr_2$ | X |
| Zr67Cu20Ni1Al12 | ○ | X | $CuZr_2$ | X |
| Zr69Cu1Ni18Al12 | X | X | — | — |
| Zr69Cu3Ni16Al12 | ○ | X | I-phase | ○ |
| Zr69Cu5Ni14Al12 | ○ | ○ | I-phase | ○ |
| Zr69Cu7Ni12Al12 | ○ | ○ | I-phase | ○ |
| Zr69Cu9Ni10Al12 | ○ | ○ | I-phase | ○ |
| Zr69Cu11Ni8Al12 | ○ | ○ | I-phase | ○ |
| Zr69Cu13Ni6Al12 | ○ | ○ | I-phase | ○ |
| Zr69Cu15Ni4Al12 | ○ | X | I-phase | ○ |
| Zr69Cu17Ni1Al12 | ○ | X | $CuZr_2$ | — |
| Zr70Cu9Ni9Al12 | ○ | ○ | I-phase | ○ |
| Zr71Cu1Ni16Al12 | X | X | — | — |
| Zr71Cu3Ni14Al12 | ○ | X | I-phase | ○ |
| Zr71Cu5Ni12Al12 | ○ | X | I-phase | ○ |
| Zr71Cu7Ni10Al12 | ○ | X | I-phase | ○ |
| Zr71Cu9Ni18Al12 | ○ | X | I-phase | ○ |
| Zr71Cu11Ni6Al12 | ○ | X | I-phase | ○ |
| Zr71Cu13Ni4Al12 | ○ | X | I-phase | ○ |
| Zr71Cu16Ni1Al12 | ○ | X | $CuZr_2$ | — |
| Zr73Cu1Ni14Al12 | X | X | — | — |
| Zr73Cu3Ni12Al12 | ○ | X | I-phase | ○ |
| Zr73Cu5Ni10Al12 | ○ | X | I-phase | ○ |
| Zr73Cu7Ni18Al12 | ○ | X | I-phase | ○ |
| Zr73Cu9Ni6Al12 | ○ | X | I-phase | ○ |
| Zr73Cu11Ni4Al12 | ○ | X | I-phase | ○ |
| Zr73Cu14Ni1Al12 | X | X | — | — |
| Zr75Cu1Ni12Al12 | X | X | — | — |
| Zr75Cu3Ni10Al12 | ○ | X | β-Zr | — |
| Zr75Cu5Ni18Al12 | ○ | X | β-Zr | — |
| Zr75Cu7Ni6Al12 | ○ | X | β-Zr | — |
| Zr75Cu9Ni4Al12 | ○ | X | β-Zr | — |
| Zr75Cu11Ni2Al12 | X | X | — | — |
| Zr77Cu3Ni8Al12 | X | X | — | — |
| Zr77Cu5Ni6Al12 | X | X | — | — |
| Zr77Cu8Ni3Al12 | X | X | — | — |
| Zr70Cu9Ni9Al12 | ○ | ○ | I-phase | ○ |
| Zr70Cu10Ni10Al10 | ○ | ○ | I-phase | ○ |
| Zr70Cu11Ni11Al8 | ○ | ○ | I-phase | ○ |
| Zr70Cu12Ni12Al6 | ○ | ○ | I-phase | ○ |
| Zr70Cu13Ni13Al4 | X | X | — | — |
| Zr70Cu8Ni8Al14 | ○ | ○ | I-phase | ○ |
| Zr70Cu7Ni7Al16 | ○ | ○ | I-phase | ○ |
| Zr70Cu6Ni6Al18 | ○ | ○ | I-phase | ○ |
| Zr70Cu5Ni5Al20 | X | X | — | — |

Furthermore, referring to Table 2, for example, $Zr_{63}Cu_7Ni_{18}Al_{12}$, $Zr_{65}Cu_7Ni_{16}Al_{12}$, and $Zr_{67}Cu_7Ni_{14}Al_{12}$ do not form a quasi-crystal cluster (I-phase), and only $Zr_{70}Cu_9Ni_9Al_{12}$ and $Zr_{69}Cu_9Ni_{10}Al_{12}$ form a quasi-crystal cluster (I-phase).

EXPERIMENTAL EXAMPLE 2

While varying the content of Nb as an additive element with respect to the $Zr_{63}Cu_{14.5-c}X_cNi_{10.5}Al_{12}$ composition, 100 μm ribbons were prepared, and subjected to differential scanning calorimetry and heat treatment, and then the structural analysis thereof was performed through X-ray diffraction analysis.

FIG. 4 is a graph showing the X-ray diffraction analysis results after the heat treatment and results of the differential scanning calorimetry of 100 μm ribbons, which have been prepared when Nb as an additive element (X) was added at 3 at. %, at 6 at. %, and at 9 at. % with respect to the $Zr_{63}Cu_{14.5-c}X_cNi_{10.5}Al_{12}$ composition that is an embodiment of the present disclosure.

Referring to FIGS. 1 and 4, it was confirmed that Icosahedral quenched-in nuclei quasi-crystal clusters in an amorphous matrix were generated with respect to the 100 μm ribbon prepared through ones in which only quasi-crystal primary phase was precipitated with respect to 100 μm ribbons which were prepared when Nb as an additive element was added at 3 at. %, at 6 at. %, and at 9 at. % with respect to the $Zr_{63}Cu_{14.5}Ni_{10.5}Al_{12}$ composition alloy that formed the primary phase of the composite phase (AlZr, $CuZr_2$) including $NiZr_2$ during heat treatment.

EXPERIMENTAL EXAMPLE 3

A 2 mm rod-shaped specimen was prepared with the $Zr_{70}Cu_9Ni_9Al_{12}$ composition, and the results of X-ray diffraction analysis and differential scanning calorimetry (DSC analysis) of the prepared rod-shaped specimen were checked, and the X-ray diffraction analysis results were checked after heat treatment up to 435° C., which is the peak point of the first crystallization behavior of the 2 mm rod-shaped specimen of the $Zr_{70}Cu_9Ni_9Al_{12}$ composition.

FIG. 5 is a graph representing the X-ray diffraction analysis results (a), and the X-ray diffraction analysis result after heat treatment progress up to the first crystallization behavior and the differential scanning calorimetry (DSC analysis) results with respect to $Zr_{70}Cu_9Ni_9Al_{12}$ composition prepared in a 2 mm rod-shaped specimen that is an embodiment of the present disclosure. Referring to FIG. 5*a*, it was confirmed that the 2 mm rod-shaped specimen of the $Zr_{70}Cu_9Ni_9Al_{12}$ composition had an amorphous structure. Thereafter, the temperature range in which crystallization behavior occurs was confirmed through differential scanning calorimetry of the 2 mm rod-shaped specimen of the $Zr_{70}Cu_9Ni_9Al_{12}$ composition, and it was confirmed that only the I-phase, which is a quasi-crystal phase, was precipitated as a primary precipitated phase when heat treatment was performed up to 435° C., which is the peak point of the first crystallization behavior. Therefore, because of the nature of the quasi-crystal phase, which is difficult to avoid the formation of clusters during the cooling process due to the ease of nucleation, it can be expected that Icosahedral quenched-in nuclei quasi-crystal clusters are formed in the amorphous internal structure prepared in the 2 mm rod-shaped specimen of the $Zr_{70}Cu_9Ni_9Al_{12}$ composition, and it was confirmed that quasi-crystal clusters were grown and precipitated through heat treatment.

EXPERIMENTAL EXAMPLE 4

2 mm rod-shaped specimens were prepared with the composition $Zr_{70}Cu_9Ni_9Al_{12}$, and differential scanning calorimetry was performed on the prepared specimens, and the prepared specimens after 10 healing cycles.

FIG. 6 is a graph representing the results of differential scanning calorimetry of an as-cast specimen and a specimen subjected to 10 healing cycles after the casting with respect to $Zr_{70}Cu_9Ni_9Al_{12}$ composition prepared in a 2 mm rod-shaped specimen that is an embodiment of the present disclosure. In the present disclosure, the healing cycle was performed through a thermo-cycling process in which an environment of −50° C. or lower and an environment of 100° C. or higher were alternately operated at intervals of at least 20 seconds or more. This thermo-cycling process can easily provide a complex environment for applying external energy such as (1) application of thermal energy according to temperature change and (2) application of local mechanical energy through repeated expansion and contraction of interatomic bonds. In addition, the application of external energy may be performed by application of external energy including one selected from the group consisting of mechanical energy, electrical energy, thermal energy, magnetic energy, and a combination thereof at a level corresponding to the above-described thermo-cycling condition.

Referring to FIG. 6, it can be seen that the enthalpy change (ΔH) of the energy region representing a gentle exothermic reaction in a low temperature range below or equal to the crystallization temperature by the amorphous structural relaxation behavior of the as-cast specimen and the specimen subjected to 10 healing cycles after the casting with respect to the $Zr_{70}Cu_9Ni_9Al_{12}$ composition prepared in a 2 mm rod shape that is an embodiment of the present disclosure has a similar value. Unlike most amorphous alloys generally exhibiting a phenomenon in which enthalpy change (ΔH) increases after a healing cycle, in the case of the alloy of the present disclosure, it was confirmed that the complexity of the amorphous structure is maximized by forming Icosahedral quenched-in nuclei quasi-crystal clusters in a composition with high Zr content, and that the amorphous structure made through casting enters a stable steady-state region, increasing the structural flexibility of the amorphous alloy.

EXPERIMENTAL EXAMPLE 5

A 2 mm rod-shaped specimen was prepared with the composition $Zr_{70}Cu_9Ni_9Al_{12}$ and a compression test was performed on it.

FIG. 7 is a graph representing the compression test results with respect to the $Zr_{70}Cu_9Ni_9Al_{12}$ composition prepared in a 2 mm rod shape, and photographs of specimen before and after the compression test. Referring to FIG. 7, it was confirmed that the rod-shaped specimen of the $Zr_{70}Cu_9Ni_9Al_{12}$ composition did not break even when compression was performed, and it has a superplastic behavior as the pressure continuously increases according to compression. The superplastic behavior of the present disclosure has a close correlation with the increased structural flexibility of the amorphous alloy by maximizing the complexity of the amorphous structure by forming Icosahedral quenched-in nuclei quasi-crystal clusters in a composition with a high Zr content.

EXPERIMENTAL EXAMPLE 6

While varying the content of Nb as an additive element (X) with respect to $Zr_{63}Cu_{14.5-c}X_cNi_{10.5}Al_{12}$ composition, 2 mm rod-shaped specimens were prepared and X-ray diffraction analysis was performed thereon. Furthermore, with respect to the $Zr_{63}Cu_{14.5-c}X_cNi_{10.5}Al_{12}$ composition, differential scanning calorimetry was performed on the specimen with prepared amorphous state while changing the content of Nb as an additive element, and X-ray diffraction analysis was performed after heat treatment was performed up to the first crystallization behavior.

FIG. 8 is a graph representing the X-ray diffraction analysis results of 2 mm rod shapes, which have been prepared when Nb as an additive element was added at 0 at. %, at 3 at. %, and at 9 at. % with respect to the $Zr_{63}Cu_{14.5-c}X_cNi_{10.5}Al_{12}$ composition that is an embodiment of the present disclosure. Referring to FIG. 8, it was confirmed that good bulk amorphous was formed when the content of the Nb was 0 at. % and 3 at. %. In contrast, when the Nb content was 9 at. %, it was confirmed that amorphous was not formed in the 2 mm rod-shaped specimen.

FIG. 9 is a graph representing the results of differential scanning calorimetry (a) and the results of X-ray diffraction analysis (b) after heat treatment progress up to the first crystallization behavior with respect to 2 mm rod-shaped specimens which have been prepared when Nb was added as an additive element at 0 at. %, and at 3 at. % to $Zr_{63}Cu_{14.5-c}X_cNi_{10.5}Al_{12}$ composition which is an embodiment of the present disclosure. Referring to FIG. 9(*a*), which is the result of the differential scanning calorimetry analysis, it was confirmed that the quasi-crystal primary precipitated phase was not precipitated alone when the Nb is not added, while when the content of the Nb was 3 at. %, there was a crystallization peak in which quasi-crystal primary precipitated phase was precipitated alone. Furthermore, referring to FIG. 9(*b*), which is the results of X-ray diffraction analysis after the heat treatment, it was confirmed that when the Nb was not added, a primary precipitated phase of the composite phase (AlZr, $CuZr_2$) including $NiZr_2$ was formed, while when the content of the Nb was added at 3 at. %, the quasi-crystal phase was precipitated as a primary phase alone, and an Icosahedral quenched-in nuclei quasi-crystal cluster was generated in the amorphous matrix.

EXPERIMENTAL EXAMPLE 7

While changing the type and content of an additive element as shown in Table 3 below with respect to $Zr_{63}Cu_{14.5-c}X_cNi_{10.5}Al_{12}$ composition, 10 μm ribbons were prepared and the results of differential scanning calorimetry were checked, and it was confirm that the quasi-crystal cluster was generated, and while changing the ratio of an additive element as shown in Table 4 below with respect to $Zr_{65}Cu_{15-c}X_cNi_{10}Al_{10}$ composition, 2 mm rod-shaped specimens were prepared and the results of differential scanning calorimetry were checked, and it was confirm that the quasi-crystal cluster was generated. Whether quasi-crystal cluster (I-phase) was generated in the amorphous matrix was summarized in Tables 3 and 4. In the table below, the formation of quasi-crystal cluster is indicated by I-phase.

TABLE 3

| Type of additive element | Size of element (nm) | Content (at. %) | 10 μm ribbon amorphous formation or not | Primary precipitated phase |
|---|---|---|---|---|
| Mo | 0.136 | 3 | ○ | I-phase |
| | | 5 | ○ | I-phase |
| | | 8 | ○ | I-phase |
| Ta | 0.143 | 3 | ○ | I-phase |
| | | 5 | ○ | I-phase |
| | | 8 | ○ | I-phase |
| Ti | 0.146 | 3 | ○ | I-phase |
| | | 5 | ○ | I-phase |
| | | 8 | ○ | I-phase |
| Zr | 0.160 | 5 | ○ | I-phase |
| | | 8 | ○ | I-phase |
| | | 9 | ○ | I-phase |
| Ag | 0.144 | 6 | ○ | I-phase |
| | | 8 | ○ | I-phase |
| | | 9 | ○ | I-phase |
| Hf | 0.158 | 7 | ○ | I-phase |
| | | 8 | ○ | I-phase |
| Pd | 0.138 | 5 | ○ | I-phase |
| | | 8 | ○ | I-phase |
| Pt | 0.139 | 5 | ○ | I-phase |
| | | 8 | ○ | I-phase |
| Au | 0.144 | 5 | ○ | I-phase |
| | | 8 | ○ | I-phase |
| Ir | 0.136 | 5 | ○ | I-phase |
| | | 8 | ○ | I-phase |
| V | 0.131 | 7 | ○ | I-phase |
| | | 8 | ○ | I-phase |
| Si | 0.115 | 2 | ○ | $NiZr_2$, AlZr, $CuZr_2$ |
| | | 5 | X | — |
| Gd | 0.180 | 2 | ○ | $NiZr_2$, AlZr, $CuZr_2$ |
| | | 5 | X | — |
| Y | 0.180 | 2 | ○ | $NiZr_2$, AlZr, $CuZr_2$ |
| | | 5 | X | — |

Referring to Table 3, it was confirmed that when the additive element was Mo, Ta, Ti, Zr, Ag, Hf, V, Pd, Pt, Au, or Ir, the quasi-crystal cluster was generated, while when the additive element was Si, Gd, or Y, the quasi-crystal cluster was not formed.

TABLE 4

| Additive alloy | Content (at. %) | 'Equation 1' calculated value | Primary precipitated phase |
|---|---|---|---|
| $Ti_{50}Ta_{50}$ | 0.6 | 0.2 | $NiZr_2$, AlZr, $CuZr_2$ |
| | 3 | 1 | I-phase |
| | 6 | 2 | I-phase |
| | 9 | 3 | I-phase |
| $Mo_{50}Nb_{50}$ | 3 | 1 | I-phase |
| | 6 | 2 | I-phase |
| | 9 | 3 | I-phase |
| $Ti_{50}Nb_{50}$ | 3 | 1 | I-phase |
| | 6 | 2 | I-phase |
| | 9 | 3 | I-phase |
| $Ag_{50}Nb_{50}$ | 7 | 1.6 | I-phase |
| | 9 | 2 | I-phase |
| $V_{50}Hf_{50}$ | 7 | 1 | I-phase |
| | 9 | 1.29 | I-phase |
| $Ti_{33}Nb_{33}Ta_{33}$ | 3 | 1 | I-phase |
| | 6 | 2 | I-phase |
| | 9 | 3 | I-phase |
| $Ti_{25}Nb_{25}Ta_{25}Mo_{25}$ | 3 | 1 | I-phase |
| | 6 | 2 | I-phase |
| | 9 | 3 | I-phase |
| $Ti_{25}Nb_{25}Ta_{25}Hf_{25}$ | 6 | 1.71 | I-phase |
| | 9 | 2.57 | I-phase |
| $Ti_{25}Nb_{25}Ta_{25}V_{25}$ | 6 | 1.71 | I-phase |
| | 9 | 2.57 | I-phase |

Referring to Table 4, it was confirmed that even when the additive element was added in various combinations, the quasi-crystal cluster was generated in the amorphous matrix.

EXPERIMENTAL EXAMPLE 8

While varying the content of Nb as an additive element (X) with respect to $Zr_{63}Cu_{14.5-c}X_cNi_{10.5}Al_{12}$ composition, 2 mm rod-shaped specimens were prepared, and compression experiments were performed thereon.

FIG. 10 is a graph representing the compression experiment results of 2 mm rod-shaped specimens, which have been prepared when Nb as an additive element was added at 0 at. %, and at 3 at. % with respect to $Zr_{63}Cu_{14.5-c}X_cNi_{10.5}Al_{12}$ composition that is an embodiment of the present disclosure.

Referring to FIG. 10, it was confirmed that when Nb as an additive element was not added with respect to $Zr_{63}Cu_{14.5-c}X_cNi_{10.5}Al_{12}$ composition, it had an elongation of 10% or less, while when the content of Nb was 3 at. %, it did not break in spite of the performed compression performed, and had superplastic behavior with the increasing pressure due to the compression.

EXPERIMENTAL EXAMPLE 9

While varying the content of Nb as an additive element (X) with respect to $Zr_{63}Cu_{14.5-c}X_cNi_{10.5}Al_{12}$ composition, 2 mm rod-shaped specimens were prepared, and after performing the compression experiment, differential scanning calorimetry was performed on the specimens that had undergone a healing cycle.

FIG. 11 is graph representing the results of differential scanning calorimetry of an as-cast specimen, a specimen after 50% compressive strain, and a specimen subjected to 10 healing cycles after 50% compressive strain with respect to $Zr_{63}Cu_{14.5-c}X_cNi_{10.5}Al_{12}$ composition prepared in a 2 mm rod shape which is an embodiment of the present disclosure.

Referring to FIG. 11, when the content of Nb was 3 at. % with respect to $Zr_{63}Cu_{14.5-c}X_cNi_{10.5}Al_{12}$, according to results of differential scanning calorimetry after 50% plastic deformation through compression experiment, it was confirmed that due to the formation of multiple shear bands, the enthalpy value (ΔH) of the amorphous structure relaxation behavior was increased by about 70% compared to the as-cast specimen. Furthermore, in the case of the specimen obtained by performing 10 healing cycles on 50% plastically deformed specimen, it was confirmed that healing against permanent deformation occurred through a unique decrease in the enthalpy value (ΔH) of the amorphous structural relaxation behavior of about 30% or more. This healing behavior about permanent deformation results from the fact that the Icosahedral quenched-in nuclei quasi-crystal cluster in a complex amorphous matrix in a composition with a high content of Zr acts as a healing core when expansion and contraction of interatomic bonds are repeated at the time of the application of external energy for healing.

While the present disclosure has been described by limited embodiments until now, the present disclosure is not limited by them, and various modifications can be made by those skilled in the art to which the present disclosure belongs within the equivalent scope of the technical idea of the present disclosure and the claims to be provided below.

The invention claimed is:

1. A healable superplastic amorphous alloy comprising Zr, Cu, Ni, Al and an additive element (X), said healable superplastic amorphous alloy being represented by Formula 1:

$$Zr_aCu_{b-c}X_cNi_dAl_f \quad \text{[Formula 1]}$$

where X is a combination of two or more selected from the group consisting of V, Mo, Nb, Ta, Ag, and Hf, b-c is 2 or more and 29 or less, c is 1 or more and 10 or less, d is 2 or more and 29 or less, f is 6 or more and 18 or less, and a is 100−(b+d+f), wherein:

the Ni and the Zr form a principal cluster;

the additive element and the principal cluster form an icosahedral quenched-in nuclei (IQN) quasi-crystal cluster;

the radius of the additive element is 75% or mor and 105% or less with respect to the atomic radius of the Zr; and wherein Equation 1 below is satisfied for the X in said Formula 1:

$$\tfrac{1}{3}(\text{at. \% of Nb})+\tfrac{1}{3}(\text{at. \% of Ta})+\tfrac{1}{3}(\text{at. \% of Mo})+\tfrac{1}{7}(\text{at. \% of V})+\tfrac{1}{7}(\text{at. \% of Hf})+\tfrac{1}{6}(\text{at. \% of Ag})\geq 1.0 \quad \text{[Equation 1].}$$

2. The healable superplastic amorphous alloy of claim 1, wherein a critical cooling rate of a cooling process of molten metal of the healable superplastic amorphous alloy is $10^0$ K/s or more and $10^6$ K/s or less.

3. The healable superplastic amorphous alloy of claim 2, wherein when the additive element is Zr, the content of the Zr is greater than 68 at. % and less than or equal to 73 at. %, the content of the Ni is 2 at. % or more and 24 at. % or less, the content of the Cu is 2 at. % or more and 24 at. % or less, and the content of the Al is 6 at. % or more and 18 at. % or less.

4. The healable superplastic amorphous alloy of claim 1, wherein the content of the Zr is 59 at. % or more and 68 at. % or less, the content of the Ni is 2 at. % or more and 29 at. % or less, the content of the Cu is 2 at. % or more and 29 at. % or less, and the content of the Al is 6 at. % or more and 18 at. % or less.

5. The healable superplastic amorphous alloy of claim 2, wherein in the cooling process of the molten metal of the healable superplastic amorphous alloy, the thickness of the molten metal is 10 μm or more and 20 mm or less.

6. The healable superplastic amorphous alloy of claim 1, wherein the healable superplastic amorphous alloy is an amorphous structure in bulk form, and wherein in a cooling process of molten metal of the superplastic amorphous alloy, a critical cooling rate is $10^0$ K/s or more and $10^3$ K/s or less.

7. The healable superplastic amorphous alloy of claim 6, wherein when the additive element is Zr, the content of the Zr is greater than 68 at. % and less than or equal to 70 at. %, the content of the Ni is 5 at. % or more and 21 at. % or less, the content of the Cu is 5 at. % or more and 21 at. % or less, and the content of the Al is 6 at. % or more and 18 at. % or less.

8. The healable superplastic amorphous alloy of claim 6, wherein the content of the Zr is 59 at. % or more and 68 at. % or less, the content of the Ni is 5 at. % or more and 26 at. % or less, the content of the Cu is 5 at. % or more and 26 at. % or less, and the content of the Al is 6 at. % or more and 18 at. % or less.

9. The healable superplastic amorphous alloy of claim 8, wherein the healable superplastic amorphous alloy is represented by Formula 2:

$$Zr_aCu_{b-c}X'_cNi_dAl_f \quad \text{[Formula 2]}$$

where X' is a combination of two or more selected from the group consisting of V, Mo, Nb, Ta, Ag, and Hf, b−c is 5 or more and 26 or less, c is 1 or more and 8 or less, d is 5 or more and 26 or less, f is 6 or more and 18 or less, and a is 100−(b+d+f).

10. The healable superplastic amorphous alloy of claim 9, wherein Equation 2 below is satisfied for the X' in said Formula 2:

$$\frac{1}{3}(\text{at. \% of Nb})+\frac{1}{3}(\text{at. \% of Ta})+\frac{1}{3}(\text{at. \% of Mo})+\frac{1}{7}(\text{at. \% of V})+\frac{1}{7}(\text{at. \% of Hf})+\frac{1}{6}(\text{at. \% of Ag})\geq 1.0 \quad \text{[Equation 2].}$$

11. The healable superplastic amorphous alloy of claim 6, wherein in the cooling process of the molten metal of the healable superplastic amorphous alloy, the thickness of the molten metal is 1 mm or more and 20 mm or less.

12. The healable superplastic amorphous alloy of claim 1, wherein the principal cluster is $NiZr_2$.

13. The healable superplastic amorphous alloy of claim 12, wherein, in the principal cluster, the Ni and the Zr form a polyhedron, and the Ni is disposed at the center of the polyhedron.

14. The healable superplastic amorphous alloy of claim 13, wherein the polyhedron is an icosahedron.

15. The healable superplastic amorphous alloy of claim 1, wherein the radius of the additive element may be 0.120 nm or more and 0.169 nm or less.

16. The healable superplastic amorphous alloy of claim 1, wherein a plastic deformation region of the healable superplastic amorphous alloy is recovered by application of external energy including one selected from the group consisting of mechanical energy, electrical energy, thermal energy, magnetic energy, and combinations thereof.

17. The healable superplastic amorphous alloy of claim 16, wherein the external energy is thermal energy, the thermal energy application is a thermo-cycling process in which an environment of −50° C. or less and an environment of 100° C. or more are alternately performed at intervals of a time period of 20 seconds or more.

* * * * *